US005931041A

United States Patent [19]

Gachy et al.

[11] Patent Number: 5,931,041

[45] Date of Patent: Aug. 3, 1999

[54] REVERSE EXTRUDING PRESS AND PROCESS FOR RELEASING A BILLET

[75] Inventors: Fernand Gachy, Rocquencourt; Alain Noterman, Puiseux; Michel Resmond, Feucherolles, all of France

[73] Assignee: Kvaerner Metals Clecim, Paris, France

[21] Appl. No.: 08/891,975

[22] Filed: Jul. 11, 1997

[30] Foreign Application Priority Data

Jul. 11, 1996 [FR] France ..... 96 08706

[51] Int. Cl.[6] ..... B21C 23/00

[52] U.S. Cl. ..... 72/273.5; 72/255; 72/257

[58] Field of Search ..... 72/264, 270, 272, 72/273.5, 253.1, 255, 257

[56] References Cited

U.S. PATENT DOCUMENTS

| | | | |
|---|---|---|---|
| 4,557,131 | 12/1985 | Wagner et al. | 72/273.5 |
| 4,606,211 | 8/1986 | Noyori et al. | 72/273.5 |
| 4,777,814 | 10/1988 | Asari et al. | 72/253.1 |
| 4,781,053 | 11/1988 | Stewart | 72/273.5 |
| 4,785,652 | 11/1988 | Stewart | 72/273.5 |
| 4,809,531 | 3/1989 | Zilges et al. | 72/273.5 |

FOREIGN PATENT DOCUMENTS

| | | |
|---|---|---|
| 0 043 025 | 6/1981 | European Pat. Off. . |
| 514735 | 12/1930 | Germany . |
| 2 094 690 | 9/1982 | United Kingdom . |

*Primary Examiner*—Joseph J. Hail, III
*Assistant Examiner*—Ed Tolan
*Attorney, Agent, or Firm*—Nikaido, Marmelstein, Murray & Oram LLP

[57] ABSTRACT

The purpose of the invention is a reverse extruding press perfected for releasing a billet jammed in the container.

According to the invention, the obturator (31) of the rear surface of the container with a thickness (e) can be replaced, by displacement transversal to the extrusion axis (10), by an extraction part (33) of the same thickness (e), fitted with a central hole (34) of the same section as that of the recess (20) of the container (2). By bringing the movable beam (3) forward, the extraction part (33) pushes the container (2) backwards as well as the rear section (53) of the billet (5) which is cleared from the recess (20) and engages into the central hole (34). The billet (5) being thus maintained, the container can be moved forward to position the pick-up means (54).

8 Claims, 4 Drawing Sheets

REVERSE EXTRUDING PRESS AND PROCESS FOR RELEASING A BILLET

The purpose of the invention is an enhanced reverse extruding press, fitted with a device for releasing a billet and also covers the releasing process implemented in such a press.

We know that such an extruding press comprises, generally, two fixed beams distant from one another between which a movable beam can be displaced, parallel to an extrusion axis, under the action of an extruding jack resting on one of both beams, whereby the latter are connected together by fixed length posts or columns in order to keep them apart. Between the movable beam and the second beam is placed a container fitted with a tubular recess centred on the extrusion axis and in which can be placed a metal billet with more or less the same cross section as the container's recess, respectively a rear end oriented towards the movable beam and towards the first fixed beam and a front end oriented towards to the second fixed beam.

The container is connected, on the other hand, with two closing parts, respectively for both ends of the recess, whereas one of these closing parts rests on the container during the extrusion process whereas the other closing part, with more or less the same cross section as the container's recess, can penetrate inside the latter under the action of the main extruding jack, while causing the extrusion of the metal of the billet through a die arranged on one of both these closing parts, which come closer to one another.

In the so-called direct method, the die is arranged on a closing part mounted on the fixed beam and on which rests the container, the latter being fixed during the extruding process. The second closing part, made of a full dowel, of the same diameter as the recess of the container, is provided at the end of a rod called rammer, which is engaged in the rear end of the recess under the action of the extruding jack, while causing the extrusion of the material by the die placed at the other end of the recess.

In the so-called reverse method, the die is supported by an annular extrusion dowel mounted at the end of a rod forming a tubular rammer resting on the second fixed beam, generally called girder. The obturator is then a massive part, of a certain thickness, interposed between the movable beam and the container.

Thus, when the movable beam is pushed towards the girder by the main extrusion jack, the extrusion dowel mounted on the fixed rammer engages into the recess of the container and the billet compressed between the obturator and the extrusion dowel is extruded by the die, whereas the profile thus formed is evacuated by the tubular rammer, than through a bore going through the girder, in the alignment of the rammer.

Generally, the obturator comprises at least one front section of the same diameter as the recess of the container, which penetrates inside the recess at the beginning of the extrusion, while resting on the billet whose progression is impeded by the fixed extrusion dowel mounted on the rammer. The billet thus compressed between the extrusion dowel and the obturator is crushed and remains stuck to the side wall of the recess, while ejecting completely the air contained in the latter. Then, the extrusion process resumes, whereas the container is pushed by the movable beam.

The extrusion technique based on the reverse method which has developed, especially, for some years, exhibits numerous advantages. One cannot, however, avoid completely some incidents liable to cause the billet to be jammed inside the recess.

For instance, if it is necessary to stop the press during extrusion, for same reason, the billet cools down inside the recess and the press capacity is then insufficient to resume the extruding process. In some cases, also, the die selected initially can prove ill-suited to the nature of the metal, to the sizes of the billet or to the capacity of the press.

When such jamming incidents take place, it is necessary to extract the billet jammed in the recess, by a so-called billet releasing or ejecting operation. However, this operation is difficult due to the fact that the billet is stuck onto the side wall of the recess.

To this end, a collection spout is generally used, interposed between the container and the obturator supported by the movable beam.

In such a case, one must first open the press by retracting the movable beam completely in order to place the collection spout, whose length must be at least equal to that of the billet, whereby the jamming can take place at the beginning of the extrusion process.

One may have to increase the distance between the movable beam and the girder by an amount of the same magnitude as the length of the billet.

The stroke of the main extrusion jack must then be increased by the same length and therefore, one must manufacture presses with an overall length of at least five times the length of the billet.

In order to reduce this length, and, consequently, the necessary distance for the placement of the collection spout, the idea has arisen to reduce the space requirements of the said spout, but, in this case, extraction of the billet can only be performed in several successive operations.

Indeed, one should first open the press to place a small-sized spout, whereas the distance is equal to the length of the spout plus the clearance necessary to its location. Thus, the container is pushed back while the movable beam is brought forward in order to clear the rear section of the billet, over a length at least equal to that of the collection spout. Then, the movable beam is pushed back once more, while maintaining the container in a fixed position, in order to place a larger-sized spout enabling, by renewed forward motion of the movable beam, to extract an additional length of billet.

The operations must be repeated as often as necessary until the billet is cleared completely.

In such a case, the increase in length of the press is limited but, conversely, the releasing operation is more complex and longer. Still, any delay in operation of the press is costly since it is reflected by a loss in production.

The purpose of the invention is to solve all these problems thanks to a perfected press, fitted with a particularly simple release mechanism, enabling moreover to avoid any increase in length of the press, the latter being limited to the length strictly necessary for normal operation, i.e. approx. three times the length of the billet, in the case of a compact press.

The invention relates, generally speaking, to an extruding press comprising two distant fixed beams, respectively a first beam and a second beam, a movable beam displaceable between both fixed beams, parallel to an extrusion axis, a container placed between the second fixed beam and the mobile beam and resting on the latter for an extrusion operation, a recess for a billet, arranged inside the said container, centred on the extrusion axis, and having two open ends, respectively, a rear end oriented towards the movable beam and a front end oriented towards the second fixed beam, an obturator of a thickness (e), displaceable axially, during the extrusion process, with the movable beam and the container, an extrusion dowel fixed axially, with a section more or less equal to that of the recess and supporting a die centred on the extrusion axis, whereas the said dowel is mounted at a rear end of a tubular rammer resting on the second fixed beam, and a main extrusion jack resting on the first fixed jack to forward the movable beam with the container while determining the penetration of the extrusion dowel into the recess and the extrusion, by the die, of the billet contained in the recess and compressed between the obturator and the extrusion dowel.

The press perfected according to the invention is fitted with an obturator mounted displaceable on the movable beam, transversally to the extrusion axis, between a first position, centred on the extrusion axis, for closing the rear end of the recess and a second position for withdrawing the obturator, and it is fitted with an extraction part of more or less the same thickness as the obturator and fitted with a central hole of a cross section at least equal to that of the recess of the container, whereby the same extraction part is mounted displaceable on the movable beam, transversally to the extrusion axis, between a first position for withdrawing the extraction part and a second position for releasing a billet, for which the central hole is centred on the extrusion axis, whereas the said central hole forms, in the second position of the extraction part, a reception space for at least a rear portion of the billet liable to be cleared from the recess of the container pushed back by the said extraction part, by forward motion of the movable beam.

According to a preferred embodiment, the central hole of the extraction part is prolonged, in the release position, by a recess arranged in the movable beam. Moreover, this recess can be prolonged advantageously by a blind hole arranged in the piston of the main extrusion jack over such a depth that the overall length of the central hole, of the recess of the movable beam and of the blind hole, is at least equal to that of a billet.

Thanks to this arrangement, it is possible to release a billet of a length greater than the thickness of the extraction part, whereas the said billet penetrate successively into the central hole of the extraction part, than into the recess of the movable beam.

The invention also covers the implementation process of an extruding press thus perfected, in case when a billet should become jammed during the extrusion inside the recess.

According to the invention, while maintaining the container blocked with the billet in its position in relation to the rammer, the movable beam is first brought backwards with the obturator over a sufficient only sufficient to separate the billet, the obturator is then pulled aside transversally and the extraction part is placed in its releasing position, centred on the extrusion axis, the movable beam is then pushed forward until the extraction part touches the container and the forward motion is continued while pushing the container back which comes away from the billet whose forward motion is blocked by the rammer. The rear section of the billet thus engages into the central hole of the extraction part, at least over the length of the latter and the movable beam is then brought backwards with the extraction part in order to clear at least a rear section of the billet on which means for picking up the billet can be engaged. The container is then brought forward to be engaged onto the rammer, while clearing the remaining rear section of the billet, the latter being maintained by the pick-up means and now able to be removed from the press.

Indeed, when the billet is maintained by the pick-up means, the container can be brought forward by engaging it on the rammer until the end of the latter arrives at the level of the rear surface of the container oriented towards the movable beam, whereas the billet is separated from the rammer, for instance using a cutter displaceable along the said rear surface of the container.

In case when the movable beam is fitted, in the extrusion axis, with a hole of the same section as the central hole of the extraction part and placed in the alignment of the former, the forward motion of the movable beam determines the engagement of a length of billet greater than the thickness of the extraction part, successively into the central hole of the latter, then into the recess of the movable beam.

According to a special embodiment, after separation of the billet, the container is brought forward by engaging it on the rammer, in order to keep in the recess of the container, only a front section of length (b), of the billet and the movable beam is brought backwards over a distance at least sufficient for positioning the pick-up means of the billet.

Preferably, the length of the front section of the billet engaged in the recess is sufficient so that the latter be maintained cantilever in the extrusion axis until the pick-up means are placed.

The billet being thus supported by the pick-up means, the container can be moved forward by engaging it on the rammer until the end of the latter reaches the rear surface oriented towards the rear surface of the container oriented towards the movable beam and the billet can then be separated from the rammer using a cutter displaceable along the said rear surface of the container, whereby the billet can then be evacuated.

But the invention will be understood better using the following description given for exemplification purposes and represented on the appended drawings.

Figure 1:
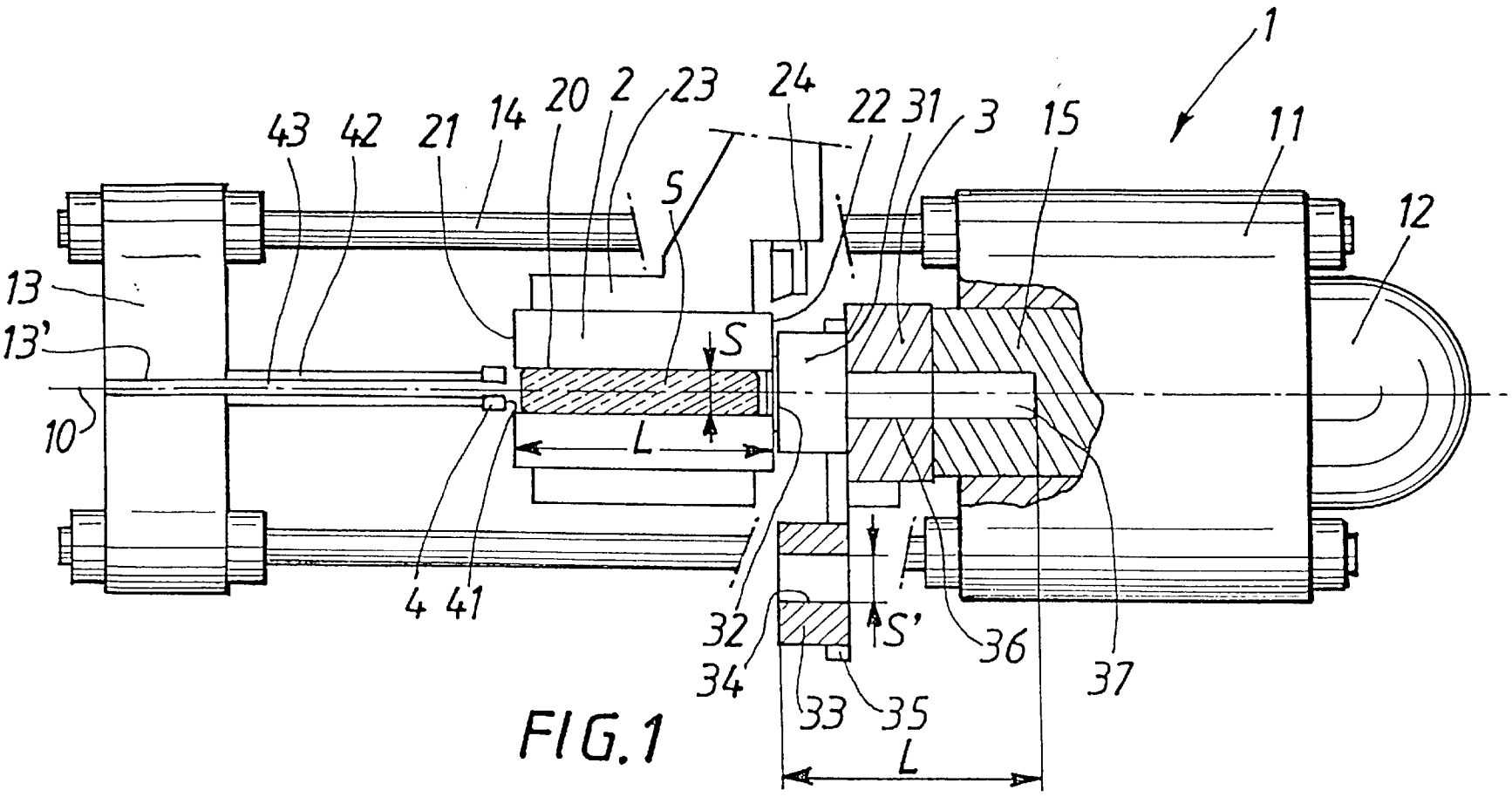
FIG. 1 represents diagrammatically an extrusion press assembly based on the reverse method.

FIG. 1 is a diagrammatic representation of an extruding press assembly 1 according to the reverse method comprising, conventionally, a first fixed beam 11 on which is mounted a main extruding jack 12 and a second fixed beam 13, often called <<girder>>, connected to the first beam 11 by column 14 liable to keep both fixed beams 11 and 13 away from each other and which can be made of prestressed posts.

Between both fixed beams 11 and 13 is placed a container 2 in which is arranged a recess 20 made of a bore with a straight section, slightly greater than that of an extrusion metal billet and which is centred on an extrusion axis 10 coinciding with the axis of the main extrusion jack 12.

The recess 20 opens, at both ends, onto both surfaces of the container 2, respectively front 21 and rear 22 surfaces, with respect to the extrusion direction, i.e. towards the second fixed beam 13. Generally, the container 2 is mounted on a cradle which can be formed on an auxiliary beam 23 liable to move between both fixed beams 11 and 13, parallel to the extrusion axis 10, under the action of auxiliary jacks, not represented.

Between the container 2 and the first fixed beam 11 extends a movable beam 3 which rests on the piston 15 of the main extrusion jack 12 and which can, generally, be also displaced parallel to the extrusion axis 10, under the action of auxiliary jacks, not represented.

As indicated above, the recess 20 is connected to two closing parts designed for closing its ends, respectively a first part 31, called obturator, which is interposed between the movable beam 3 and the container 2 and a second part 4 with a cross section slightly smaller than that of the recess 20 in order to engage into the recess 20 during the extrusion process.

With reverse extrusion, the obturator 31 is made of a massive part mounted on the movable beam 3 and exhibiting a front surface 32 which may lean against the rear surface 22 of the container 2 in order to close the corresponding end of the recess 20.

At its other end, the recess 20 can engage onto the second closing part 4 which forms an annular extrusion dowel on which is mounted a die 41 centred on the extrusion axis 10. The extrusion dowel 4 is mounted at the end of a rammer 42 constituted of a tubular rod drilled with a central bore 43 and fixed on the girder 13. The bore 43 is centred on the extrusion axis 10 and prolonged by a hole 13' going through the girder 13.

The length of the rammer 42 is such that the die 41 is located at a distance from the girder 13 at least equal to the length (L) of the recess 20 of the container 2 corresponding to the maximum length of billets to be extruded. Thus, the container 2 can engage completely onto the rammer 42, whereby the die 41 reaches the level of the rear surface 22.

Moreover, a remainder cutter 24 mounted on the container-carrier beam 23 can move along the rear surface 22 of the container in order to separate the profile 51 from the metal remainder, at the end of the extrusion process, between the obturator 31 and the extrusion dowel 4.

As indicated, auxiliary jacks, not represented, enable to perform manoeuvres independent from the cradle 23 carrying the container and from the movable beam 3.

Especially, in the example represented, to allow loading a new billet into the container 2, the container 2 is first engaged completely on the rammer 42, and the movable beam 3 is pushed back so that the obturator 31 is located at a distance (L' ) from the rear end of the rammer 42 and from the extrusion dowel, a distance greater than the length (L) of the container 2.

It is thus possible to place a billet 5 in the extrusion axis 10, between the extrusion dowel 4 and the obturator 31 and to push the container 2 backwards, which engages on the metal billet 5 to be extruded, whereby the latter has a straight section and a length shorter than the cross section and the length of the recess 20.

The billet being thus loaded into the recess 20, in the position represented on FIG. 1, extrusion may take place under the action of the main jack 12 whose piston 15 pushes the movable beam 3 backwards, which rests on the container 2 either directly or, in most cases, via the obturator 31.

The container 2 closed by the obturator 31 is thus pushed backwards by the movable beam 3 and the recess 20 engages on the extrusion dowel 4 which is fixed and leans against the billet 5 while closing the front end of the recess 20. The billet 5 is then crushed between the movable obturator 31 and the fixed extrusion dowel 4 and the thrust action of the main jack 12 causes the extrusion of the billet via the die 41 and the formation of a profile leaving through the bore 43 of the rammer and the hole 13' of the girder.

Generally, the obturator 31 is fitted, on its front surface, with a protruding section 31', of a diameter slightly smaller than that of the recess 20 which can thus penetrate into the latter while resting directly on the billet, in order to cause the latter to sag at the beginning of the extrusion process, while expelling the air contained between the billet and the wall of the recess 20. The assembly formed by the part 31 and the protruding section 31' has a thickness (e).

All these arrangements constitute the conventional extrusion method, based on the reverse principle and a reverse extruding press comprises, generally, the devices which have just been described diagrammatically, but can, obviously, be subject to variations or improvements.

Figure 2:
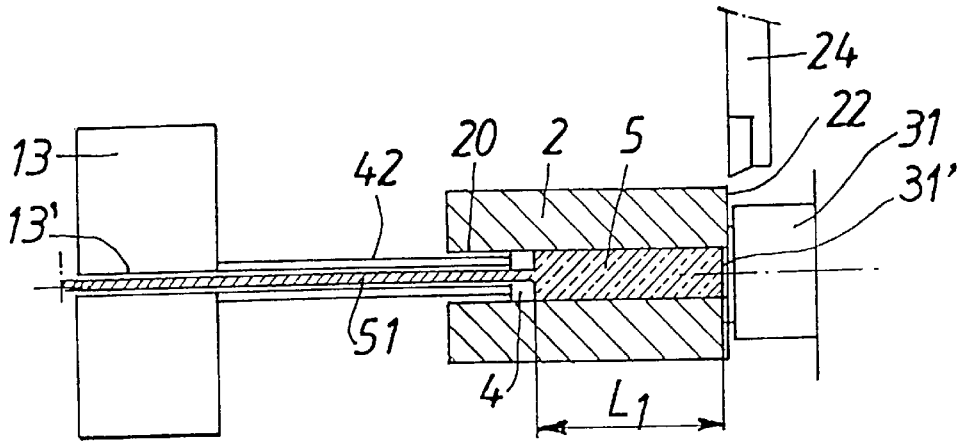
FIGS. 2 to 9 are partial diagrams illustrating the different stages of the releasing process according to the invention.

As we all know, there can be incidents causing the billet to jam inside the container during extrusion, in the position illustrated for exemplification purposes and diagrammatically on FIG. 2.

In order to release the billet without any encumbrance, according to the invention, the press is fitted with a release mechanism which can quite advantageously be applicable to a compact press, whereby the device can be suited to a extant press without increasing the length of the said press.

This release mechanism comprises essentially an extraction device 33 constituted of a tubular part whose thickness (e) is more or less equal to that of the obturator 31 in order to be able to replace the latter in the extrusion axis without pushing the movable beam backwards.

The extraction device 33 is a simple massive part, tubular in shape, fitted with a central hole 34 whose straight section (s') is more or less identical to that (s) of the recess 20 and, anyway, at least equal to the latter.

The obturator 31 as well as the extraction part 33 can be installed removable on the movable beam 3 in order to allow the replacement of one by the other. This operation can be performed manually but, preferably, the obturator 31 and the extraction 33 are mounted on a replacement device, for instance a rotary part forming a kind of barrel 35 comprising two arms carrying, respectively, the obturator 31 and the extraction part 33 and mounted pivoting on the movable beam around a central axis parallel to the extrusion axis 10 in order to allow, by simple rotation of the barrel 35, the positioning of one of both parts in the extrusion axis 10.

This arrangement has been represented only very diagrammatically on FIG. 1, whereas the barrel 35 is connected, of course, to guiding means on the beam, means to control the rotation and means to lock the obturator 31 or the extraction part 33 in a position centred on the is extrusion axis.

Besides, other arrangements could be used, for instance, a ram 35 displaceable along the front surface of the movable beam 3, perpendicular to the extrusion axis 10, and on which the obturator 31 and the extraction part 33 are mounted apart from one another so that they can slide transversally to be positioned alternately in the extrusion axis.

Moreover, the movable beam 3 is fitted with a recess 36 centred on the extrusion axis 10 and having the same straight section (s') as the central hole 34 of the extraction part 33.

Preferably, if the total thickness of the movable beam 3 and of the extraction part 33 is smaller than the length of a billet, the recess 36 is prolonged in the axis of the piston 15 of the main jack 12 by a blind hole 37 whose bottom is placed at a distance (L') from the front surface of the obturator 31 at least equal to the length of a billet 5.

On FIGS. 2 to 9 which illustrate the stages of the release process according to the invention, only the essential parts of the press have been represented.

As shown on FIG. 2, the billet was jammed during the extrusion, whereas the extrusion dowel 4 has penetrated inside the recess 20 in which a length (L1) of the billet 5 remains stuck on the internal surface of the recess 20 and is jammed inside the container 2, whereby extrusion cannot be performed any longer.

Figure 3:
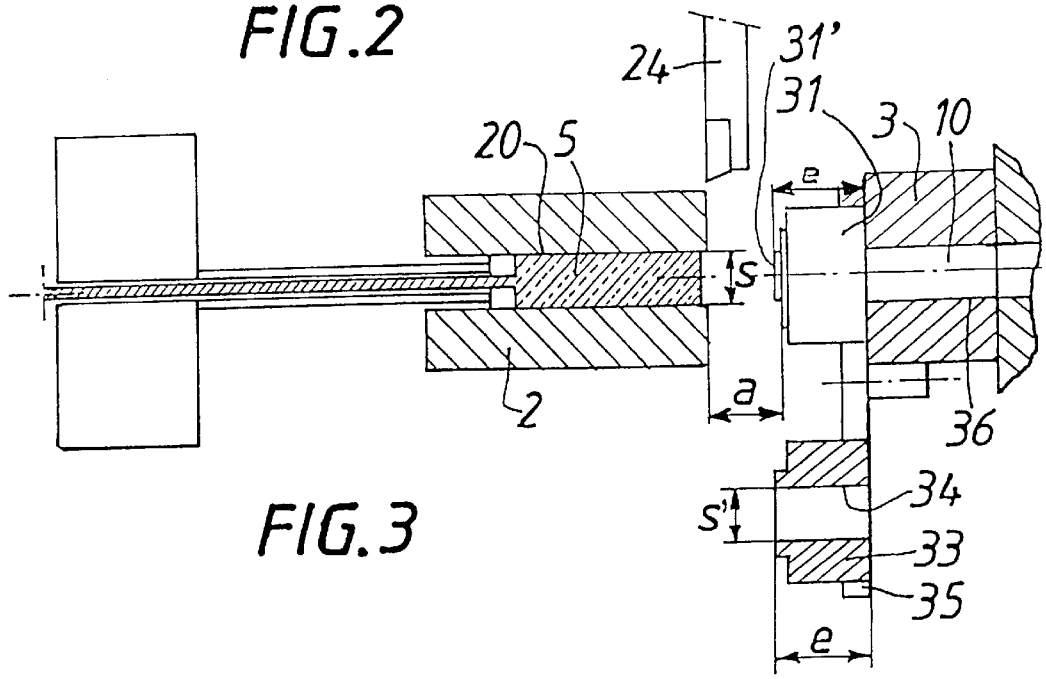

According to a first stage of the process represented on FIG. 3, the movable beam 3 is pushed backwards over a short distance (a) so that the obturator 31 comes away from the billet 5 jammed in the recess 20.

Figure 4:
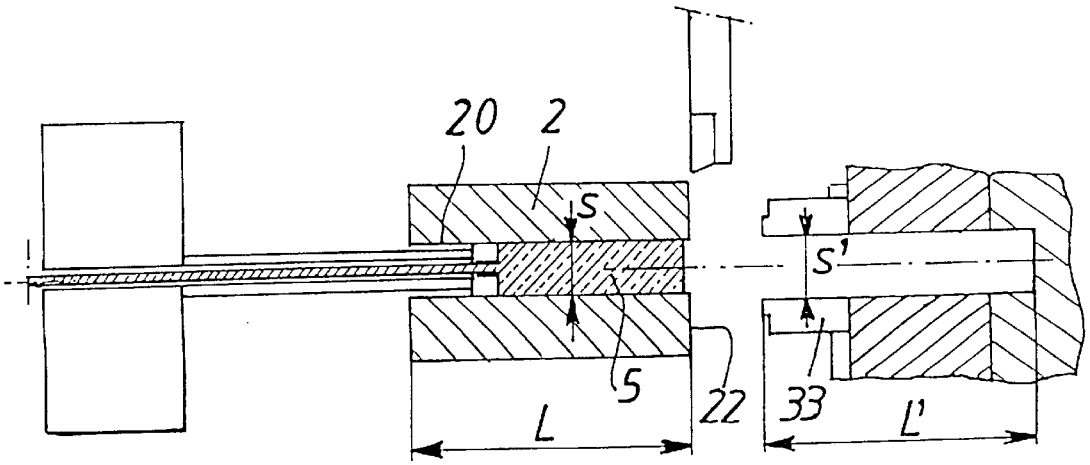

The obturator 31 thus cleared can be removed by rotating the barrel 35 which positions the extraction part 33 in the extrusion axis, as represented on FIG. 4 where the holes 34, 36 and 37 are located in the alignment of one in relation to another and form a recess of length (L') more or less equal to the length (L) of the recess 20 of the container 2.

Then, again, the movable beam 3 is brought forward until the extraction part 33 bears on the rear surface 22 of the container 2 and the forward motion of the movable beam 3 is continued under the action of the main jack 12 or of auxiliary jacks for displacing the movable beam when the former have been provided and generate sufficient load.

Figure 5:
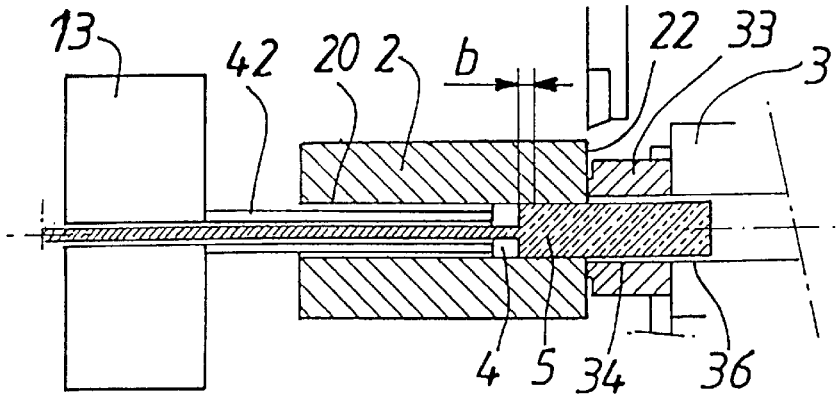

Under the effect of this thrust, the billet 5 comes away from the recess 20 and the container 2 can move forward towards the girder 13 by engaging on the rammer 42, in the position represented on FIG. 5. Thus, the billet 5 jammed by the extrusion dowel 4 comes away from the recess 20 and engages at the same time into the central hole 34 of the extraction part 33 then, if need be, into the hole 36 of the movable beam 3.

This forward motion of the movable beam is, however, stopped before the billet 5 is cleared completely when the rear surface 22 of the container is located at a distance (b) of the extrusion dowel 4, so that the front section 52 of the billet 5 remains inside the recess 20.

Figure 6:
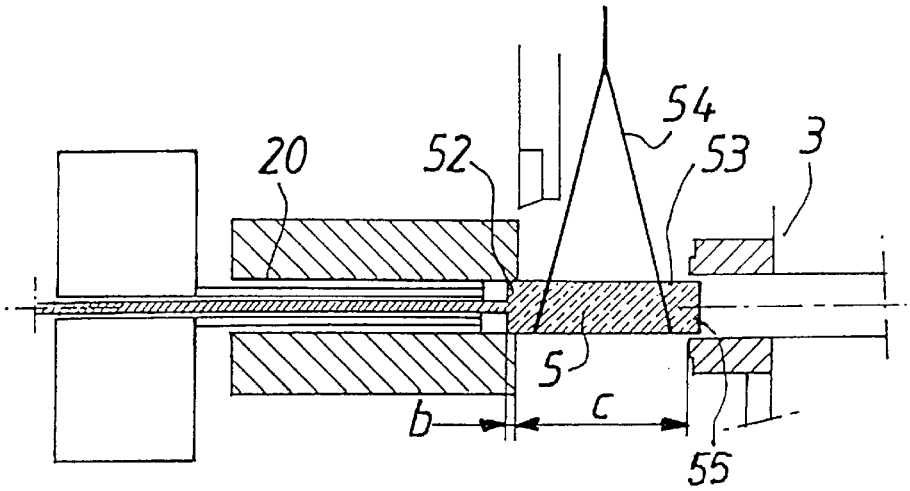

The movable beam 3 is then again pushed backwards in the position represented on FIG. 6 and over a distance (c) exposing a free section 53 of the billet enabling to pick up the latter using adequate means 54 such as a sling or a loading shovel.

This distance (c) can be simply sufficient to enable the pick-up means 54 to be positioned, whereby the billet is maintained, until it is picked up, by both its ends 52, 55 engaged, respectively, into the recess 20 and the extraction part 33.

Figure 7:
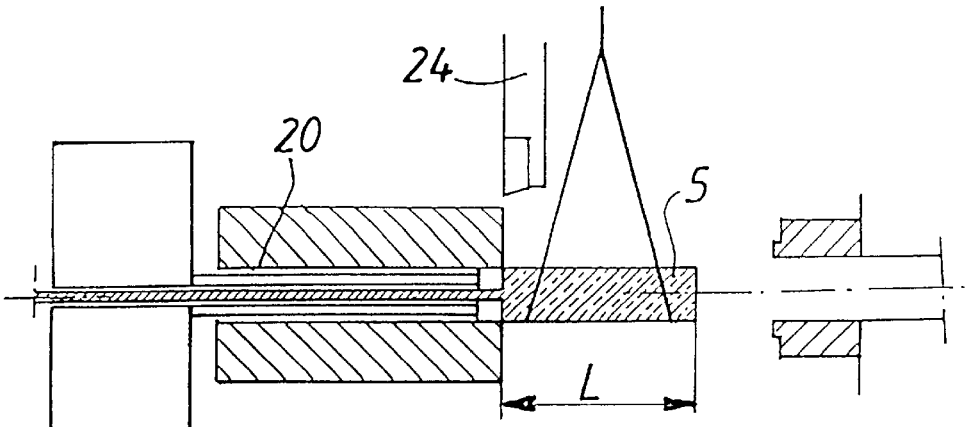

In the following stage, represented on FIG. 7, the billet 5 being supported by the pick-up device 54, the container 10 is placed, using its auxiliary jacks, in its forward position for which its rear surface 22 is in the end plane of the die-carrier dowel 4 and the movable beam 3 is placed in its retracted position for which the extraction part 33 is at a distance (L') from the die-carrier dowel 4 greater than the maximum length (L) of the billet 5.

However, if the distance (b) is sufficient so that the billet 5 is maintained cantilever by its front section 52 still engaged in the recess 20, it is possible to push the movable beam 3 directly backwards until its retracted position, to allow loading the next billet without further manoeuvring of the movable beam 3.

Figure 8:
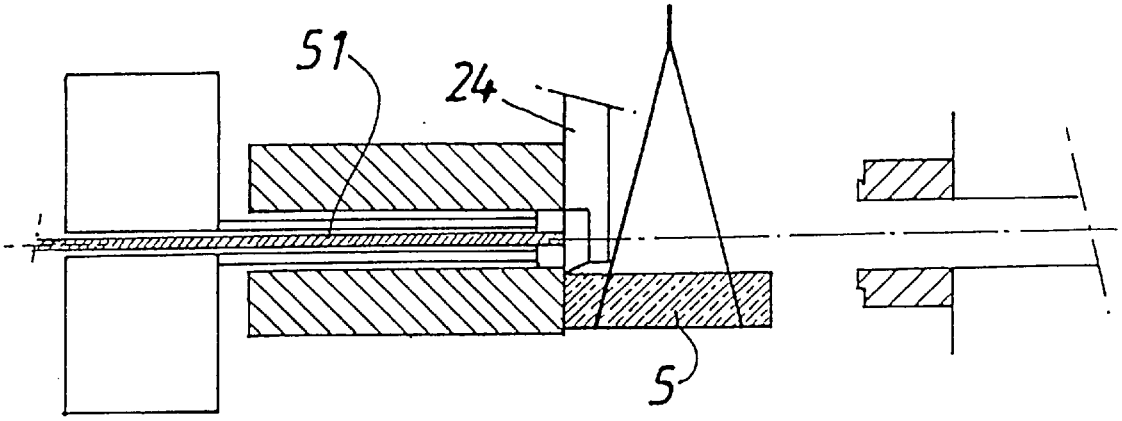

As indicated on FIG. 8, the cutter 24 is then operated in order to separate the profile 51 from the billet 5 which can finally come away from the press under the effect of the pick-up means 54.

Figure 9:
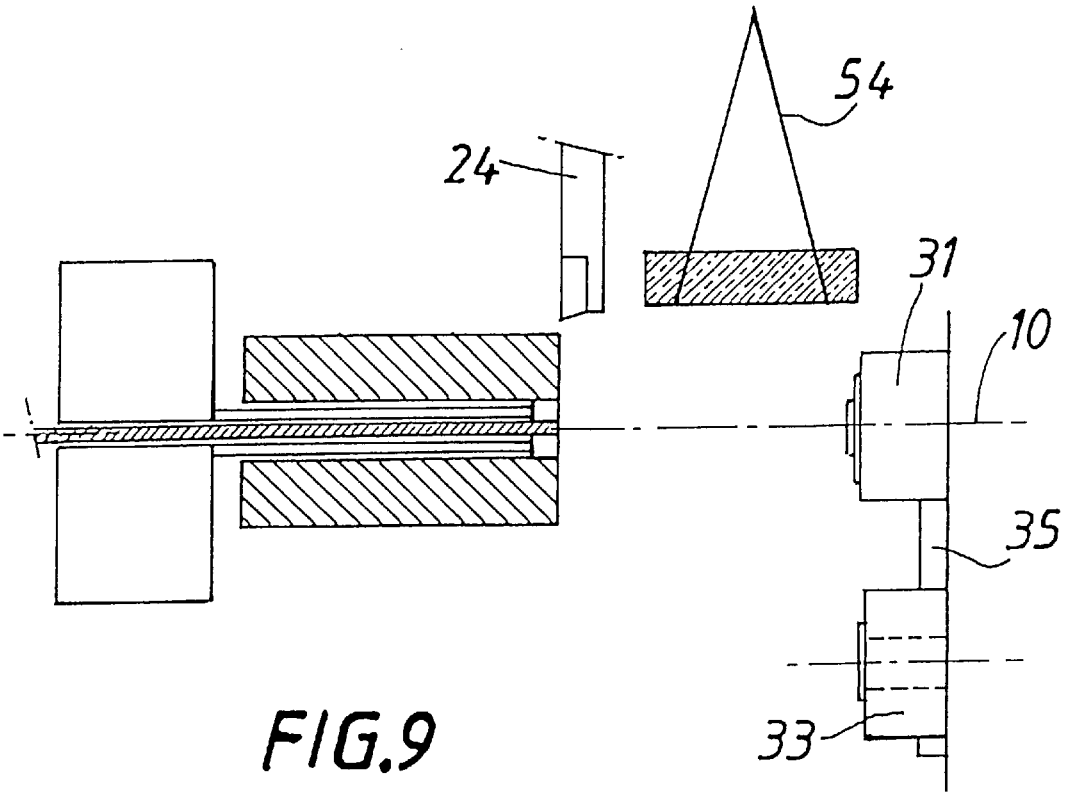

FIG. 9 shows the final stage of the process. The cutter 24 is recalled into its home position and the obturator 31 is brought back into extruding position by rotation of the barrel 35, whereas the extraction part 33 comes back to its initial position away from the extrusion axis.

The press is then ready for a new extrusion stage.

It can be seen that the advantages of the process just previously described, are manifold.

In the case of a new press, the invention enables to maximise the structure of the former while reducing the distance between the girder and the movable beam since the said distance can be in practice simply equal to, give or take the necessary clearances, the sum of the rammer's length and the container's length. Such a press can thus be of a global length corresponding to three times the container's length.

Consequently, deformations of the structure of the press are reduced, notably those of the linking columns or posts between the girder and the fixed beam supporting the main jack.

The stroke of the press being reduced with respect to conventional presses, it follows that the longevity of the mobile elements and of the friction parts (gaskets of the jacks, friction pads, etc.) can be lengthened noticeably, since the length covered during each cycle is halved with respect to usual systems.

Besides, reducing the overall space requirements enables diminishing the civil engineering works as well as the costs relating to the buildings.

A press according to the invention will also be more easily implemented in an existing environment, for instance, to replace an older press with a new press, in the very same premises, whereby, the said press can be more powerful and enable to extrude longer billets, without increasing the space requirements.

Moreover, in the case of an existing press, the invention enables to simplify considerably the release operation of the billet by avoiding the use of a set of spouts of various lengths positioned successively according to the conventional procedure.

Thanks to the invention, conversely, after positioning the release obturator, the billet can be cleared completely in a single operation by simply bringing the movable beam forward.

Obviously, the invention is not limited to the details of the embodiment just described previously, but could be subject to variations while remaining within the protection framework defined by the claims.

In particular, the invention is applicable, generally speaking, to any reverse extruding press and does not prevent from using conventional accessories since the retrofitting of the press in order to implement the process simply consists in drilling a recess in the axis of the main jack, whereas the replacement of the obturator with the tubular extraction part can be performed by any suitable means or even manually.

The reference signs inserted after the technical data mentioned in the claims solely aim at making the understanding of the latter easier and do not limit their extent in any way.

We claim:

1. An extruding press based on the reverse method comprising:

two fixed beams distant from one another, respectively a first beam and a second beam, a movable beam displaceable between both fixed beams, parallel to an extrusion axis, a container located between the second fixed beam and the movable beam and resting on the movable beam for an extrusion operation, a recess for a billet, arranged inside the container, centered on the extrusion axis and having two open ends, respectively a rear end oriented towards the movable beam and a front end oriented towards the second fixed beam, an obturator with a thickness (e) along the extrusion axis mounted on the movable beam, for movement transversally to the extrusion axis, between a first obturator position, centered on the extrusion axis closing the rear end of the recess and a second obturator position aside from the extrusion axis, an extrusion dowel, with a section substantially equal to that of the recess and carrying a die centered on the extrusion axis, the dowel being mounted at one end of a tubular rammer resting on the second fixed beam, a main extruding jack resting on the first fixed beam designed for moving the movable beam with the container engaging the extrusion dowel into the recess and extrusion of the billet contained in the recess and compressed between the obturator and the extrusion dowel through the die into the tubular rammer, an extraction part with substantially the same thickness (e) along the extrusion axis as the obturator and fitted with a central hole of a section at least equal to that of the recess of the container, wherein the extraction part is mounted displaceable on the movable beam, transversally to the extrusion axis, between a first extraction part position away from the movable beam and a second extraction part position for releasing a billet, for which the central hole is centered on the extrusion axis, the central hole forming, in the second position of the extraction part, a reception space for at least a rear section of the billet to be cleared from the recess of the container by the extraction part by bringing the movable beam forward, means mounted on the press for moving the obturator between the first and second obturator positions and the extraction part between the first and second extraction part positions.

2. An extruding press according to claim 1, wherein in the release position, the central hole of the extraction part axially abuts a recess provided in the movable beam having a cross-section which is the same as the central hole.

3. An extruding press based on the reverse method comprising:

two fixed beams distant from one another, respectively a first beam and a second beam, a movable beam displaceable between both fixed beams, parallel to an extrusion axis, a container located between the second fixed beam and the movable beam and resting on the movable beam for an extrusion operation, a recess for a billet, arranged inside the container, centered on the extrusion axis and having two open ends, respectively a rear end oriented towards the movable beam and a front end oriented towards the second fixed beam, an obturator with a thickness (e) along the extrusion axis mounted on the movable beam, for movement transversally to the extrusion axis, between a first obturator position, centered on the extrusion axis closing the rear end of the recess and a second obturator position aside from the extrusion axis, an extrusion dowel, with a section substantially equal to that of the recess and carrying a die centered on the extrusion axis, the dowel being mounted at one end of a tubular rammer resting on the second fixed beam, a main extruding jack resting on the first fixed beam designed for moving the movable beam with the container engaging the extrusion dowel into the recess and extrusion of the billet contained in the recess and compressed between the obturator and the extrusion dowel through the die into the tubular rammer, an extraction part with substantially the same thickness (e) along the extrusion axis as the obturator and fitted with a central hole of a section at least equal to that of the recess of the container, wherein the extraction part is mounted displaceably on the movable beam, transversally to the extrusion axis, between a first extraction part position away from the movable beam and a second extraction part position for releasing a billet, for which the central hole is centered on the extrusion axis, the central hole forming, in the second position of the extraction part, a reception space for at least a rear section of the billet to be cleared from the recess of the container by the extraction part by bringing the movable beam forward, means mounted on the press for moving the obturator between the first and second obturator positions and the extraction part between the first and second extraction part positions;

wherein in the release position, the central hole of the extraction part axially abuts a recess provided in the movable beam having a cross-section which is the same as the central hole, and wherein a blind hole arranged in a piston of the main extruding jack axially abuts the recess and has a depth such that the overall length of the central hole, of the recess of the movable beam and of the blind hole, is at least equal to the length of a billet.

4. A process for releasing a billet in a reverse extruding press fitted with a release mechanism according to claim 1, wherein when a billet is jammed inside the recess during extrusion, the container blocked with the billet is maintained in position in relation to the rammer, the movable beam is brought backwards with the obturator over a distance only sufficient to separate the billet, the obturator is then pulled aside transversally, into the obturator second position away from the extrusion axis and the extraction part is placed in the extraction part second position centered on the extrusion axis, the movable beam is then brought to a position until the extraction part touches the container and the motion is continued while pushing the container backward which comes away from the billet whose motion is blocked by the rammer, the rear section of the billet thus engaging into the central hole of the extraction part, at least over the length of the central hole, the movable beam is then brought backwards with the extraction part in order to clear at least a rear section of the billet, whereas means for picking up the billet are engaged on the rear section, the container is then brought forward to be engaged onto the rammer, while clearing a remaining section of the billet, the billet being maintained by the pick-up means and now the billet supported by the pick-up means can be removed from the press.

5. A process for releasing a billet according to claim 4, wherein the billet being maintained by the pick-up means, the container can be brought forward by engaging it on the rammer until the end of the rammer arrives at the level of the rear surface of the container oriented towards the movable beam, whereas the billet is separated from the rammer, using a cutter displaceable along the rear surface of the container.

6. A process for releasing a billet according to claim 4, wherein the movable beam being fitted, in the extrusion axis, with a recess of the same as the central hole of the extraction part aligned with said central hole when the extraction part is in the second extraction position, the forward motion of the movable beam determines the engagement of a length of billet greater than the thickness (e) of the extraction part, successively into the central hole of the extraction part, then into the recess of the movable beam.

7. A process for releasing a billet according to one of claims 4 to 6, wherein after separation of the billet, the container is brought forward by engaging the container on the rammer, in order to keep in the recess of the container, only a front section of a part of the length of the billet and the movable beam is brought backwards over a distance at least sufficient for positioning the pick-up means of the billet.

8. A process for releasing a billet according to claim 7, the part of the length of billet maintained engaged in the recess is sufficient for the billet to be supported in a cantilever manner in the extrusion axis and for the movable beam to be placed directly in a retracted position for which the extraction part lies at a distance from the die greater than the maximum length of the billet.

* * * * *